US007318639B2

(12) United States Patent
Udagawa

(10) Patent No.: US 7,318,639 B2
(45) Date of Patent: Jan. 15, 2008

(54) INKJET RECORDING APPARATUS

(75) Inventor: Kenta Udagawa, Yokohama (JP)

(73) Assignee: Canon Kabushiki Kaisha

( * ) Notice: Subject to any disclaimer, the term of this patent is extended or adjusted under 35 U.S.C. 154(b) by 378 days.

(21) Appl. No.: 11/109,191

(22) Filed: Apr. 19, 2005

(65) Prior Publication Data

US 2005/0231566 A1 Oct. 20, 2005

(30) Foreign Application Priority Data

Apr. 20, 2004 (JP) ..... 2004-124598

(51) Int. Cl.
*B41J 2/175* (2006.01)

(52) U.S. Cl. ..... 347/85

(58) Field of Classification Search ..... 347/85, 347/86, 87; 141/2, 18
See application file for complete search history.

(56) References Cited

U.S. PATENT DOCUMENTS 4,419,678 A * 12/1983 Kasugayama et al. ..... 347/86
4,999,652 A * 3/1991 Chan ..... 347/86
5,971,529 A 10/1999 Pawlowski
6,481,837 B1 * 11/2002 Askren et al. ..... 347/85
6,517,189 B2 * 2/2003 Ogawa et al. ..... 347/35
6,540,321 B1 * 4/2003 Hirano et al. ..... 347/22
6,612,683 B2 9/2003 Takahashi
6,637,872 B2 10/2003 Ara
6,702,433 B2 3/2004 Kono
6,966,641 B2 * 11/2005 Taniguchi et al. ..... 347/86

FOREIGN PATENT DOCUMENTS

JP 8-300677 A 11/1996
JP 2002-160386 A 6/2002

* cited by examiner

*Primary Examiner*—Anh T. N. Vo
(74) *Attorney, Agent, or Firm*—Canon U.S.A. Inc I.P. Div

(57) ABSTRACT

In a recording apparatus in which ink is supplied to a head from a main tank via a sub-tank, when ink is supplied to the sub tank from the main tank, the ink is first supplied to a flow path connected to the sub-tank, and then ink is supplied into an ink absorber accommodated within the sub-tank via a filter being in contact with the absorber. The flow path is located between the ink absorber and the head. The ink is supplied into the sub-tank from the main tank in the reverse direction of the flow path for supplying ink to the recording head from the absorber during ink ejection. As a result, after ink is supplied to the sub-tank from the main tank, ink portions contained in the ink absorber and the filter are united into one continuous portion, so that a recording apparatus preventing the failure of ink supply due to ink discontinuity can be provided.

4 Claims, 7 Drawing Sheets

INKJET RECORDING APPARATUS

BACKGROUND OF THE INVENTION

1. Field of the Invention

The present invention relates to inkjet recording apparatuses, and in particular relates to an inkjet recording apparatus in which ink is supplied from a main tank to a sub-tank mounted on a carriage together with a recording head for storing ink to be supplied to the recording head.

2. Description of the Related Art

A serial-type inkjet recording apparatus has been known, in which the recording head is moved in a principal scanning direction so as to form images on a recording sheet while the recording sheet is conveyed by a predetermined distance in a direction perpendicular to the principal scanning direction.

The recording head mounted on a carriage is constructed so as to receive ink from an ink tank in a mounted state on the carriage.

For supplying ink to the recording head, there have been generally known a system (on-carriage system), in which ink is supplied from an ink tank mounted on a carriage together with the recording head, and a system (off-carriage system), in which ink is supplied from an ink tank arranged at a predetermined position other than the carriage to the recording head via a sub-tank mounted on the carriage.

In the on-carriage system, when the kind and amount of ink are increased, the carriage becomes larger in size and heavier in weight due to the increased space for mounting the ink tank.

Furthermore, a drive mechanism for driving the carriage is also scaled up due to the added weight, and a space must be ensured for carriage scanning.

Thus, the on-carriage system has a problem of further increase in size for comparatively large scale recording apparatuses having a large capacity ink tank.

The off-carriage system has an ink supply mechanism including a main tank fixed on the apparatus and the sub-tank moving on the carriage within the apparatus and stably connected to the main tank with a tube.

Japanese Patent Laid-Open No. 2002-234180 (corresponding to U.S. Pat. No. 6,702,433) discloses an ink supply mechanism of the off-carriage system in that the main tank and the sub-tank are stably connected together with a tube.

This patent document illustrates a method for generating negative pressure in the recording head when ink is supplied to the recording head using a difference in hydraulic head between the main tank and the recording head.

Japanese Patent Laid-Open No. 8-300677 discloses that the sub-tank is enclosed from the atmosphere and the negative pressure in the recording head is given by a difference in hydraulic head between the main tank and the recording head in the same way as in Japanese Patent Laid-Open No. 2002-234180.

The off-carriage system may include an ink supply system in that a supply path between the main tank and the sub-tank is disconnected during the movement of the carriage for recording and then the carriage is moved to a predetermined position when necessary so as to connect the main tank to the sub-tank.

In the system disconnecting the supply path between the main tank and the sub-tank during the movement of the carriage, difference in hydraulic head between the main tank and the recording head cannot be used upon generating negative pressure during supplying ink to the recording head. Hence, the negative pressure is generally produced in the sub-tank. For generating the negative pressure in the sub-tank, there are known methods where the negative pressure is produced by increasing the volume of an ink reservoir by a spring force, and the negative pressure is generated by a capillary force of an ink absorber such as a polyurethane foam and a fiber bundle.

In Japanese Patent Laid-Open No. 10-128992, the negative pressure is produced by a spring force. This is comparatively complicated in structure; however, miniaturization is possible.

In Japanese Patent Laid-Open No. 2001-310477 (corresponding to U.S. Pat. No. 6,637,872) and No. 2002-086745 (corresponding to U.S. Pat. No. 6,612,683), methods for generating the negative pressure using an ink absorber are described, and these methods have an advantage of simplicity in structure.

FIG. 5 is a sectional view of a conventional structure using an ink absorber in the sub-tank.

To make the drawing easily understandable, a wide space between an absorber 208 and a sub tank 202 is shown in the drawing; however, in practice the absorber is pressed into contact with the inner wall of the sub-tank with ribs formed on the inner wall of the sub-tank so as to have very small clearance therebetween. The following drawings are the same.

As shown in FIG. 5, the absorber 208 accommodated inside the sub-tank 202 contains ink 213, which is supplied to a recording head 201 via a filter 207.

The sub tank 202 is provided with a porous gas-liquid separation membrane 209 with a water-repellent surface arranged on the absorber 208. The gas-liquid separation membrane is provided with micro pores formed therein, and when a predetermined pressure difference is applied across the thickness of the gas-liquid separation membrane, gas is permeable through the pores while the pores do not transmit liquid.

The sub-tank 202 is provided with a connection part arranged on the side wall for a supply tube 204 for connecting the sub tank to a main tank 203. The supply tube 204 includes a valve 210 which is closed in the period of time other than that for supplying ink from the main tank 203 to the sub tank 202. In such a manner, the sub-tank 202 is hermetically sealed with the valve 210 other than the pores of the gas-liquid separation membrane and the recording head 201.

During ink ejection from the recording head, the negative pressure of the absorber 208 is applied to the recording head so as to enable the recording head to be efficiently supplied with ink from the sub-tank.

Even when a structure which separates the tube off during recording is adopted, a valve is provided in the same way, so that a closed system is secured when the tube is separated.

An evacuation tube 205 from the sub-tank 202 through the gas-liquid separation membrane 209 arranged above the sub-tank 202 is connected to a pump 211, which is driven when ink is supplied from the main tank to the sub tank.

On the other hand, in the period of time other than that for supplying ink, the sub-tank communicates with the atmosphere, so that the pressure in the sub-tank 202 can be maintained at atmospheric pressure through the evacuation tube 205. The evacuation tube 205 may be constructed to be separable from the sub tank, and in this case, the pressure in the sub-tank 202 can be maintained at atmospheric pressure through an open hole of the tube.

For supplying ink from the main tank to the sub tank, a method to pressurize the main tank 203 or a method to change the potential head between the main tank 203 and the sub-tank 202 may also be adopted.

FIGS. 6A to 6C are drawings for illustrating ink behavior within the sub-tank 202, wherein FIG. 6A shows situations in which the ink 213 contained in the absorber 208 in the sub-tank 202 is consumed along with ink ejection from the recording head 201 so that a boundary 214 between the ink and the atmosphere is falling down.

FIG. 6B shows situations in which at the time when residual ink is reduced by the ink consumption mentioned above, the pump 211 is driven so as to supply ink from the main tank 203. That is, gas is aspirated via the evacuation tube 205 and the gas-liquid separation membrane 209 by driving the pump 211, thereby depressurizing the insides of the sub-tank 202.

By the pressure difference due to the depressurization, ink is supplied from the main tank 203 so that the absorber 208 is impregnated with the ink and the boundary 214 comes up. FIG. 6C shows a state that by further supplying ink from the main tank 203, the absorber 208 is filled with the ink 213 so that the boundary 214 reaches the gas-liquid separation membrane 209. Since the gas-liquid separation membrane 209 does not transmit ink at this time, when the ink 213 reaches the entire surface of the gas-liquid separation membrane 209, the entire bottom surface of the gas-liquid separation film 209 is brought into contact with ink, and gas is not aspirated from the upper surface of the gas-liquid separation membrane 209. This terminates the ink supply from the main tank 203 to the sub-tank 202. By repeating the behavior shown in FIGS. 6A to 6C, the state that ink is supplied to the recording head can be maintained.

However, in the system in that the absorber is accommodated within the sub tank so as to generate the negative pressure therein and to supply ink from the main tank to the recording head via the sub-tank, as described with reference to FIGS. 5 and 6A to 6C, when ink is supplied to the recording head, ink may occasionally stop being supplied from the sub-tank.

FIGS. 7A to 7C are drawings illustrating this phenomenon.

FIG. 7A shows a state in which ink contained in the absorber 208 in the sub-tank 202 is consumed along with ink ejected from the recording head 201 so that the start of ink supply is at the time when the boundary 214 fairly falls down. That is, along with ink ejection from the recording head, the boundary 214 between ink and the atmosphere descends. However, the start of ink supply may lag behind the established ink-filling timing in a state in which the boundary 214 further falls down because of consumption measurement error, ink evaporation, and wrong operation. At this time, as shown in FIG. 7A, the ink 213 supplied from the main tank is moved higher than the connection part of the supply tube 204 so as not to sufficiently mix with ink existing in the vicinity of the filter 207 because the boundary 214 falls down, forming individual ink portions.

FIG. 7B shows a state in which ink is further supplied from the main tank from the above state so that the ink reaches the entire gas-liquid separation membrane 209. As shown in FIG. 7B, when the ink portion supplied from the connection part of the supply tube 204 reaches the bottom surface of the gas-liquid separation membrane 209 in a state in which individual ink portions are formed, the entire bottom surface of the gas-liquid separation membrane 209 is covered with ink. Thus, gas in the sub tank cannot pass through the gas-liquid separation membrane 209 from the inside of the sub tank so as to stop further ink supply. As a result, a large portion D not containing the ink 213 remains in the absorber 208. Simultaneously, there are provided an ink portion E bordering on the filter 207 and an ink portion F ranging from the connection part of the supply tube 204 to the gas-liquid separation membrane 209 formed individually. Thus, the two ink portions E and F may come in contact with each other with a small section 215 (FIG. 7B) therebetween, or although not shown, the ink portions E and F may be formed separately from each other. FIG. 7C is a drawing showing a state that after the ink in that state is supplied from the main tank, the ink in the absorber 208 is consumed by the ink ejection from the recording head 201.

In the ink supply to the recording head 201, when ink is supplied to the recording head in the state in which the two ink portions E and F come in contact with each other with a small section therebetween or they are formed separately from each other as described above, in comparison with the state in which the ink portions E and F are continuous as shown in FIG. 6C, the state of FIG. 7C has fewer ink continuous portions, finally resulting in ink discontinuity and ejection failure at the recording head 201.

Such a phenomena is liable to be generated especially when the volume of the ink absorber is large or in a case where ink is difficult to have a continuous state so that the filter area of a portion supplying ink to the recording head is increased.

Thus there has been a problem that the inkjet recording apparatus cannot keep up with the speeding up of the recording head and increase in consumption and size.

SUMMARY OF THE INVENTION

The present invention is directed to an inkjet recording apparatus capable of preventing the failure of ink supply to a recording head in a system in which ink is supplied from a main tank to the recording head via a sub-tank.

In one aspect of the present invention, an inkjet recording apparatus includes a recording head ejecting liquid therefrom; a sub-tank configured to couple to the recording head so as to supply liquid to the recording head, the sub-tank including a negative pressure generating member arranged therein and communicating with the atmosphere for supplying liquid to the recording head; a carriage movably supporting the recording head and the sub-tank; a main tank arranged outside the carriage and adapted to store liquid; a supply path for supplying the liquid from the main tank; and a flow path located between the negative pressure generating member and the recording head. The flow path includes a connection part adapted to connect to the supply path. The liquid from the main tank is supplied to the sub-tank via the supply path and the flow path.

According to the structure described above, the supply path for supplying ink to the sub-tank from the main tank is connected to the flow path between the sub-tank and the recording head so as to supply ink.

During ink supply from the main tank to the sub-tank, ink is moved from the connection part of the supply path to the negative pressure generating member.

That is, ink is moved in the reverse direction of the flow path for supplying ink to the recording head from the sub-tank. Thereby, some amount of ink to be supplied to the recording head is left in a state remained in the negative pressure generating member within the sub-tank.

When ink is supplied to the sub-tank from the main tank, by the ink supplied, the ink contained in the negative pressure generating member is united to the ink supplied to the recording head from the sub-tank.

As a result, the failure of ink supply thereafter from the sub-tank to the recording head due to ink discontinuity cannot occur, preventing the failure of ink supply during recording.

The present invention provides a recording apparatus preventing dust and air bubbles from entering the nozzles of the recording head.

In one embodiment, the recording apparatus according to the present invention may further include a filter located at any one of positions between the flow path and the negative pressure generating member; between the flow path and the recording head; and between the connection part of the flow path and the supply path.

According to the structure described above, in the case where ink is supplied from the main tank via the flow path, or ink is supplied to the recording head from the sub-tank via the flow path, dust contained in ink is removed with the filter. Thus, a recording apparatus supplying dust-free ink to the nozzles of the recording head can be provided.

According to the structure having the filter between the connection part of the flow path and the supply path, when the ink contained in the sub-tank is supplied to the recording head via the flow path, the filter for removing dust of the ink supplied from the supply path becomes unnecessary to be interposed. Hence, a recording apparatus that can suppress changes smaller in ink pressure due to a head loss of the ink flow can be provided.

The recording apparatus according to the present invention may further include depressurizing unit operable to depressurize the sub-tank.

The recording apparatus according to the present invention may further include a gas-liquid separation film provided in a connection portion between the sub-tank and the depressurizing unit.

The recording apparatus according to the present invention may further include the depressurizing unit reduces the pressure of the sub-tank inside so as to supply liquid to the sub-tank from the main tank in a state of the supply path connected to the flow path.

The recording apparatus according to the present invention may further include the depressurizing unit comprises a depressurizing path, and wherein the sub-tank is detachable from the depressurizing path.

In another embodiment, the flow path is constructed integrally with the recording head and be detachable with the supply tube.

According to the structure described above, in addition to the original effect of preventing the failure of ink supply to the recording head from the sub-tank due to the ink supply from the main tank to the sub-tank, the carriage can be moved in a state that the ink supply tube is not connected to the carriage having the head mounted thereon, so that a recording apparatus with a small space for carriage movement can be provided. Furthermore, the ink ejection is not affected by vibration of ink within the ink supply tube during the movement of the carriage for scanning, further preventing the failure of ink supply to the recording head.

In another embodiment, the recording head may be formed integrally with the flow path, and may be detachable with the sub-tank.

According to this structure, in addition to the original effects, when defective conditions are encountered in the recording head, the recording head becomes detachable from/to the apparatus, improving operability of the recording apparatus.

Further features and advantages of the present invention will become apparent from the following description of exemplary embodiments with reference to the attached drawings.

DESCRIPTION OF THE EMBODIMENTS

Embodiments according to the present invention will be described below with reference to the drawings.

First Embodiment

Figure 1:
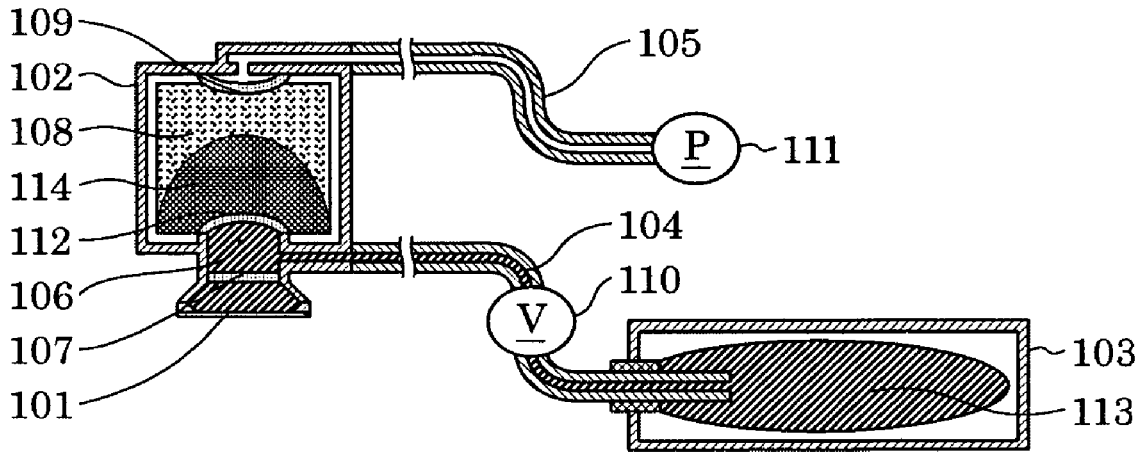
FIG. 1 is a sectional view of an ink supply system of a recording apparatus according to a first embodiment of the present invention.

FIG. 1 is a sectional view of an ink supplying system of an inkjet recording apparatus according to a first embodiment of the present invention.

As shown in the drawing, the ink supplying system according to the embodiment is composed of a main tank 103, a sub-tank 102, and a recording head 101 connected to the main and sub-tanks, and the main tank 103 and the sub-tank 102 are connected together via a supply tube 104 having a valve 110 arranged at its intermediate portion.

The sub-tank 102 and a pump 111 are connected together via an evacuation tube 105. A first feature of an ink supply system according to the embodiment is that a connection part of the supply tube 104 to the sub-tank 102 is located not on the side wall of the sub-tank 102 but on a flow path 106 of the recording head 101.

Figure 6A:
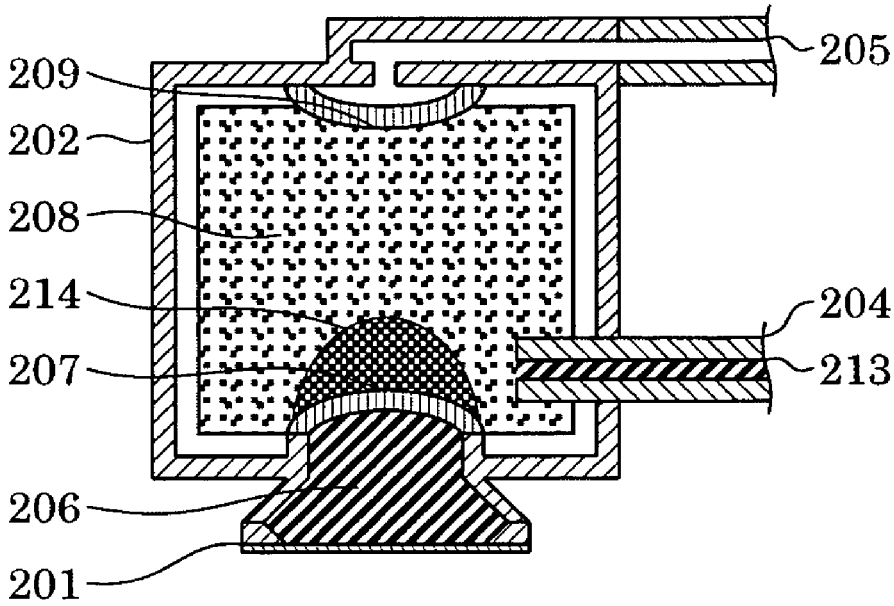
FIG. 6A PRIOR ART
FIGS. 6A to 6C are sectional views illustrating ink situations within a sub-tank of the conventional recording apparatus when ink is supplied.
Figure 6B:
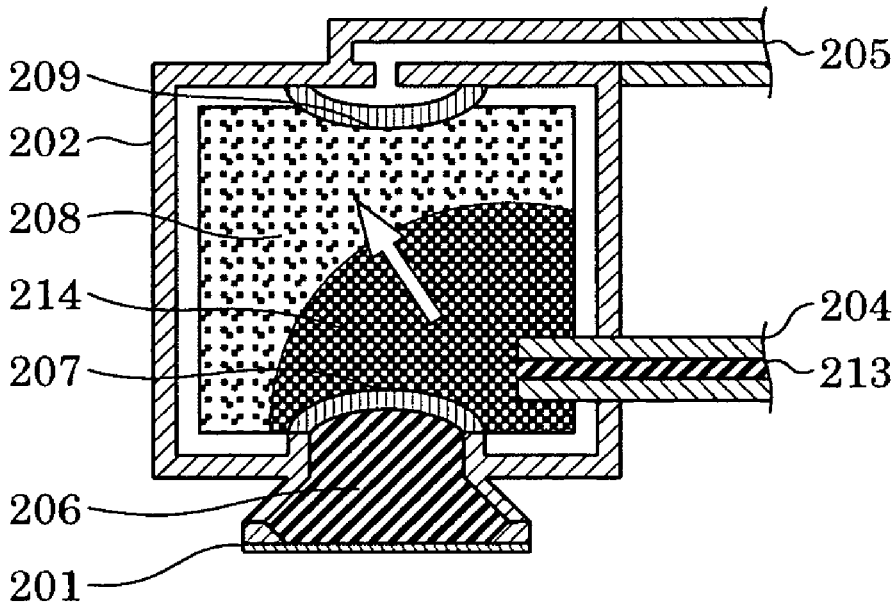
FIG. 6B PRIOR ART
Figure 6C:
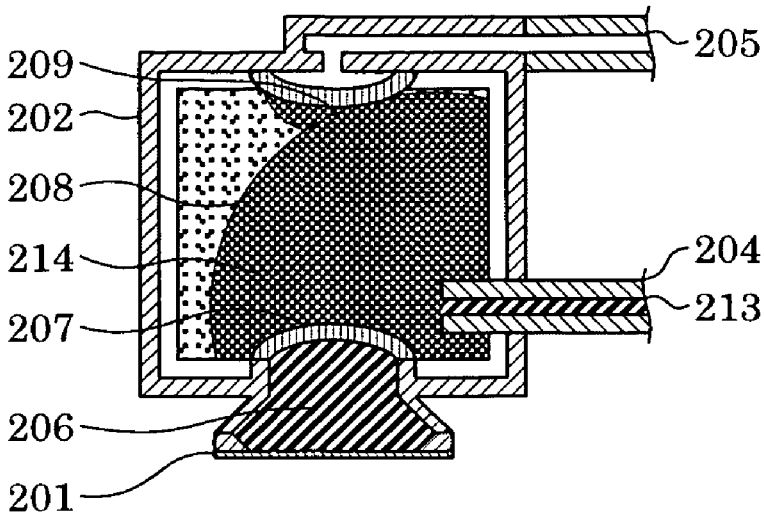
FIG. 6C PRIOR ART

Other principal structures are substantially the same as conventional structures described with reference to FIGS. 6A to 6C.

Referring to FIG. 1, the flow path 106 of the recording head 101 located downstream of a filter 107 provided on the boundary between the sub-tank 102 and the recording head 101 is a flow path commonly communicating with respective ink paths corresponding to a plurality of ink nozzles of the recording head 101.

Ink is supplied to the respective ink paths of the recording head 101 from the sub-tank 102 via the flow path 106. According to the embodiment, the supply tube 104 is provided so as to communicate with a hole formed in the flow path.

Within the flow path 106, the ink absorber is not accommodated so that ink is directly stored in the space of the flow path 106.

On a surface of the flow path 106 opposite to the filter 107, a filter 112 is provided. Dust contained in ink supplied to the recording head 101 from the main tank 103 via the flow path 106 is removed with the filter 107 so as to prevent dust and air bubbles from entering the nozzles of the recording head 101.

An inkjet printer according to the embodiment has known structures in addition to the structure shown in FIG. 1. That is, although not shown in FIG. 1, a carriage having the recording head 101 and the sub-tank 102 mounted thereon is moved in a direction perpendicular to the plane of FIG. 1 so as to scan a recording medium such as paper with the recording head 101.

By ejecting ink toward the recording medium from the recording head 101, images are recorded on the recording medium located at a position opposing the recording head 101 and conveyed in a direction perpendicular to the head scanning direction.

During the recording scanning or during moving of the carriage for a purpose other than the scanning, the supply tube 104 and the evacuation tube 105 move along the movement of the carriage.

Figure 2A:
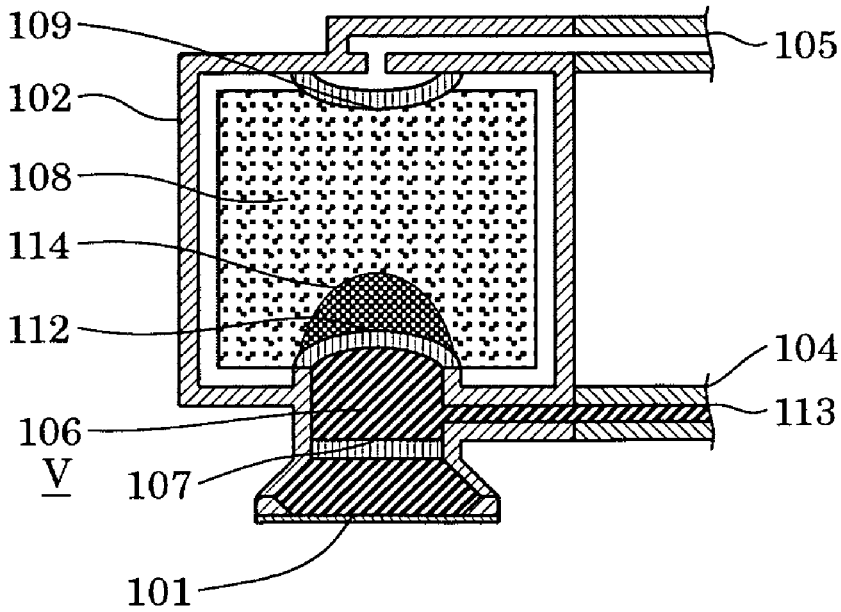
FIGS. 2A to 2C are sectional views illustrating ink situations within a sub-tank according to the first embodiment.
Figure 2B:
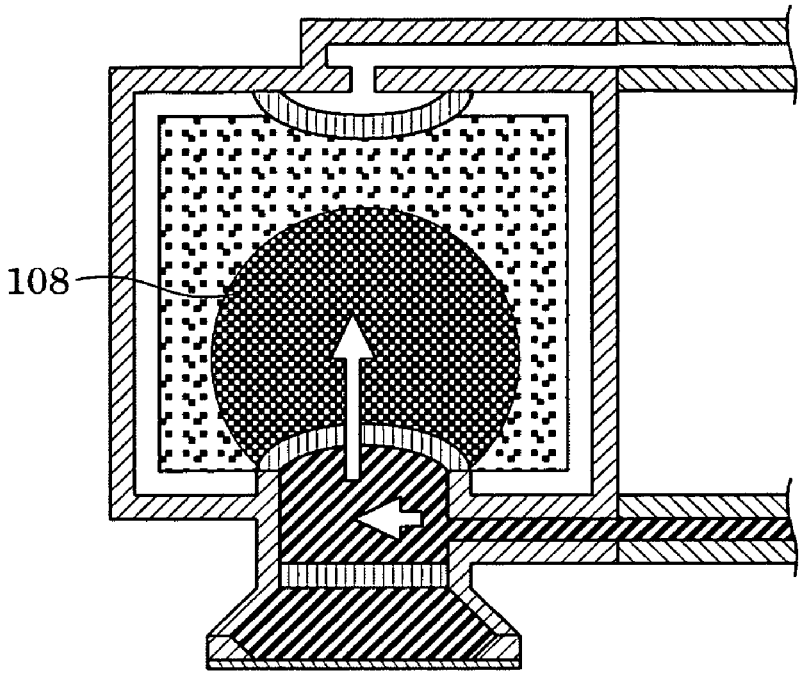
Figure 2C:
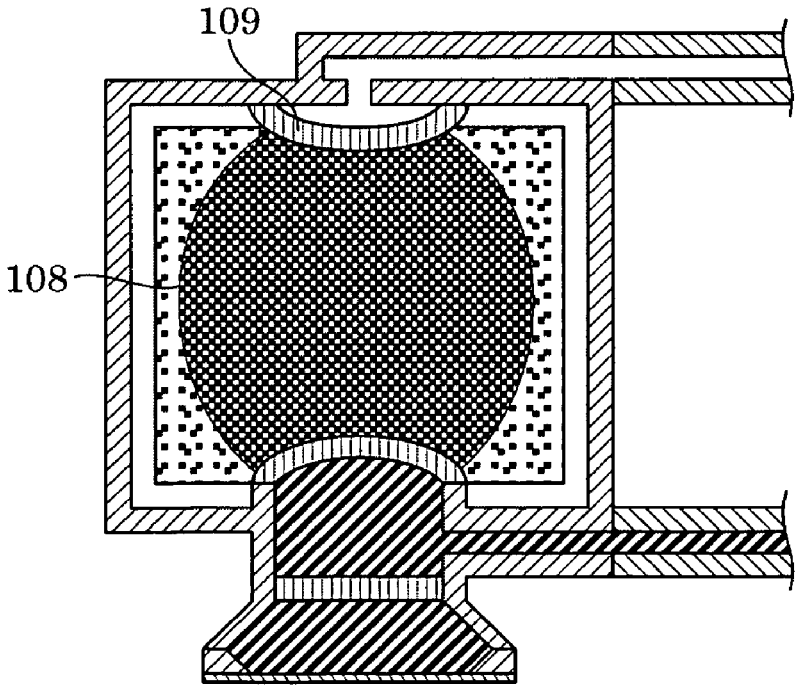

FIGS. 2A to 2C are sectional views illustrating a recording apparatus having the ink supply system described above, especially about ink movement within the sub-tank.

As shown in FIG. 2A, ink 113 contained in an ink absorber 108 within the sub-tank 102 is consumed along with ink ejection from the recording head 101 so that a boundary surface 114 between ink and the atmosphere comes down. Then, at a time when the boundary surface 114 comes down to a position exhibiting a certain level of ink residue, the value 110 of the supply tube 104 is opened while the pump 111 is driven so that gas is aspirated from the sub-tank 102 via the evacuation tube 105 connected to the upper portion of the sub-tank 102. As shown in FIG. 2B, ink is thereby supplied to the flow path 106 at first from the supply tube 104 connected to the flow path 106 of the recording head 101.

The ink absorber 108 is impregnated with the supplied ink with the filter 112 therebetween so that the boundary surface 114 comes up again.

Finally, as shown in FIG. 2C, the ink 113 contained in the ink absorber 108 occupies a large percentage of the volume of the ink absorber 108 while the boundary surface 114 reaches a gas-liquid separation membrane 109.

When the ink 113 reaches the entire surface of the gas-liquid separation membrane 109 in such a manner, gas cannot come out of the sub-tank 102, so that ink movement is stopped in the sub-tank 102 so as to complete the ink supply to the sub-tank 102.

As described above, according to the embodiment, when ink is supplied to the sub-tank 102 from the main tank 103, the ink is firstly supplied to the flow path 106 of the recording head 101 connected to the sub tank 102, and then, the ink is supplied to the ink absorber 108 via the filter 112 being in contact with the ink absorber 108.

Thus, ink is supplied into the sub-tank 102 from the main tank 103 in the reverse direction of the flow path 106 for supplying ink to the recording head 101 from the ink absorber 108 during ink ejection.

Figure 7A:
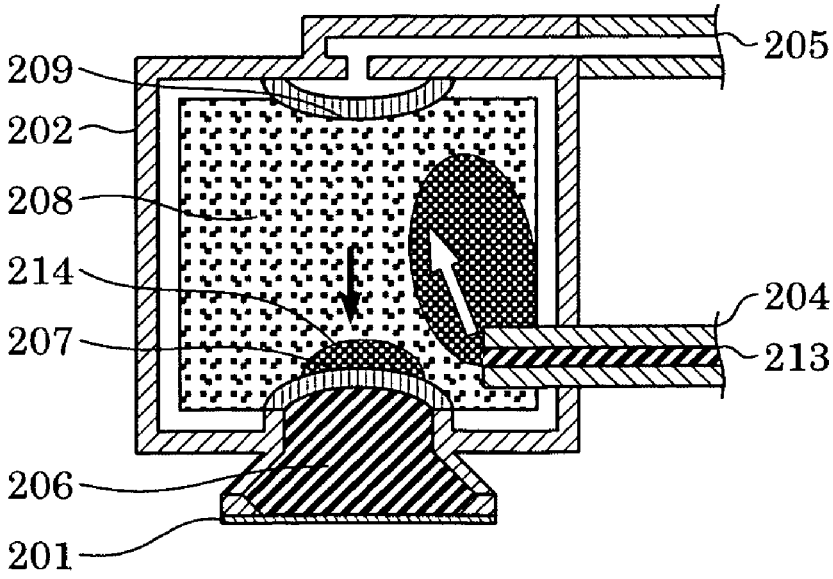
FIG. 7A PRIOR ART
FIGS. 7A to 7C are sectional views illustrating ink situations within the sub-tank of the conventional recording apparatus when ink supply is stagnant.
Figure 7B:
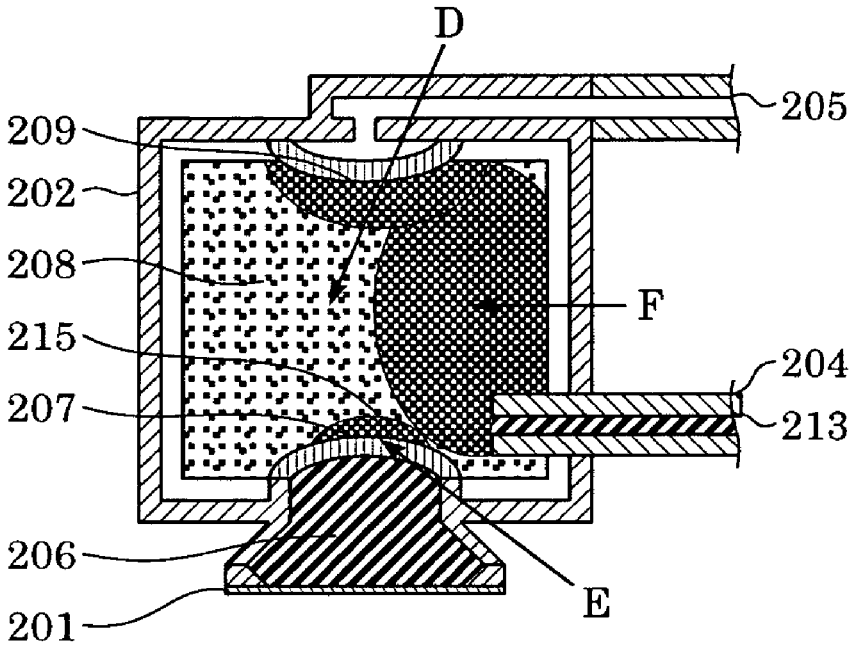
FIG. 7B PRIOR ART
Figure 7C:
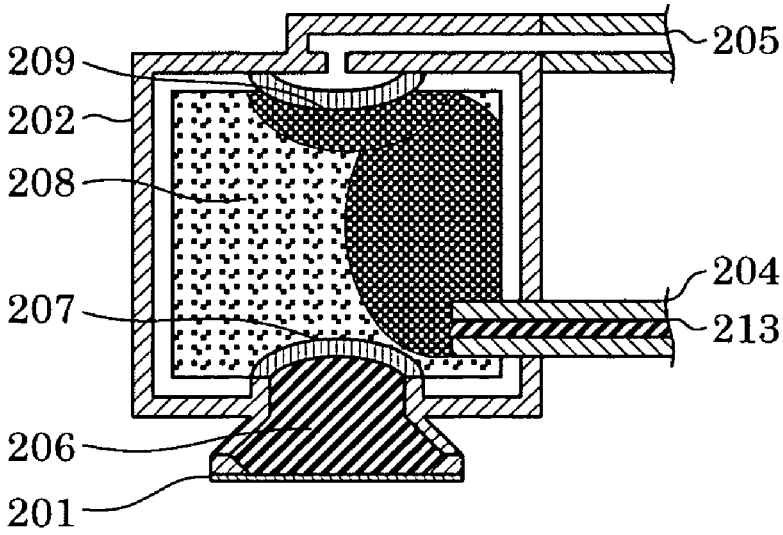
FIG. 7C PRIOR ART

Hence, the two ink portions E and F shown in FIGS. 7A to 7C cannot be generated in the ink absorber 108 within the sub-tank 102.

As a result, after ink is supplied to the sub tank 102 from the main tank 103, as shown in FIG. 2C, the ink portions contained in the ink absorber 108 and the filter 112 are united into one continuous portion.

Thereby, the ink supply failure due to ink discontinuity in the ink absorber of the sub-tank can be prevented.

Second Embodiment

Figure 3:
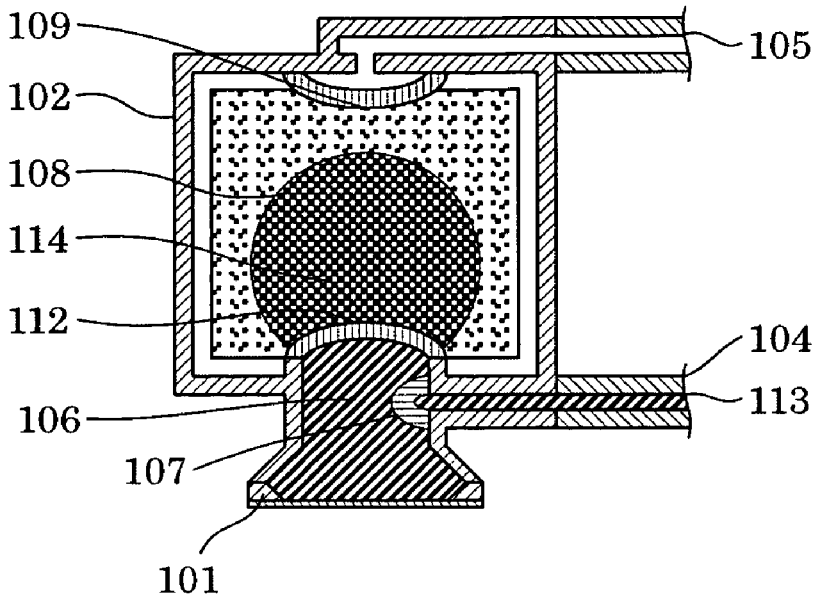
FIG. 3 is a sectional view of a sub-tank and a recording head according to a second embodiment of the present invention.

FIG. 3 is a sectional view of an ink supply system according to a second embodiment of the present invention, especially showing the structure of a sub-tank and a recording head.

A point in which the structure of the embodiment differs from that of the first embodiment is that the filter 107 is provided so as to cover a hole formed in connection part between the flow path 106 and the supply tube 104.

Whereas the filter 107 shown in FIG. 1 is arranged across a supply section in a direction perpendicular to the ink supplying direction from the sub-tank toward the recording head, the filter 107 shown in FIG. 3 does not traverse the flow path 106 for supplying ink to the head in a direction perpendicular to the ink supplying direction.

According to the above second embodiment, when ink contained in the ink absorber 108 in the sub-tank is supplied to the recording head 101, the filter through which the ink passes is only one, so that in comparison with the first embodiment having two filters through which ink passes, changes in ink supply pressure due to a head loss of the ink flow can be suppressed smaller.

Third Embodiment

Figure 4A:
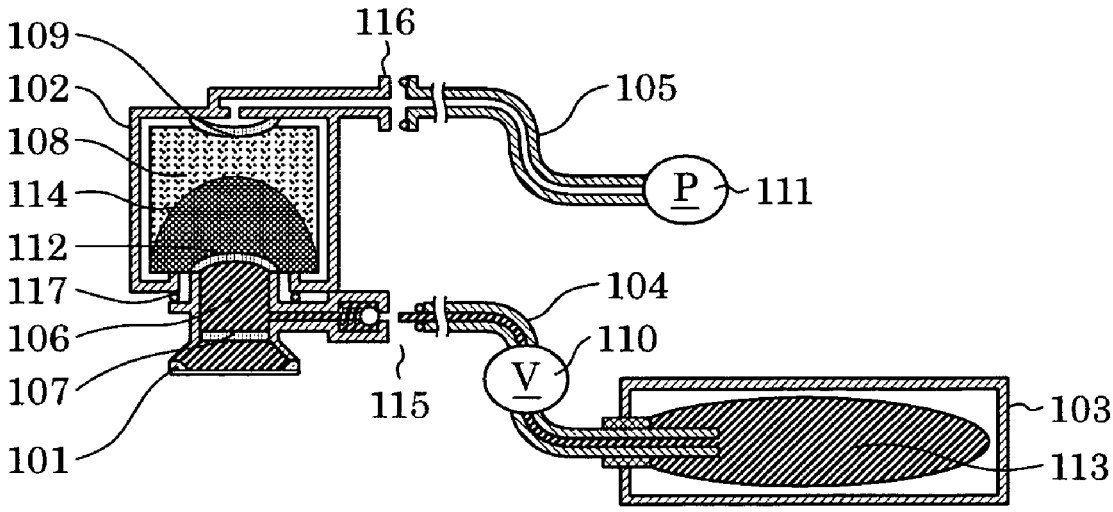
FIGS. 4A and 4B are sectional views of an ink supply system of a recording apparatus according to a third embodiment of the present invention.
Figure 4B:
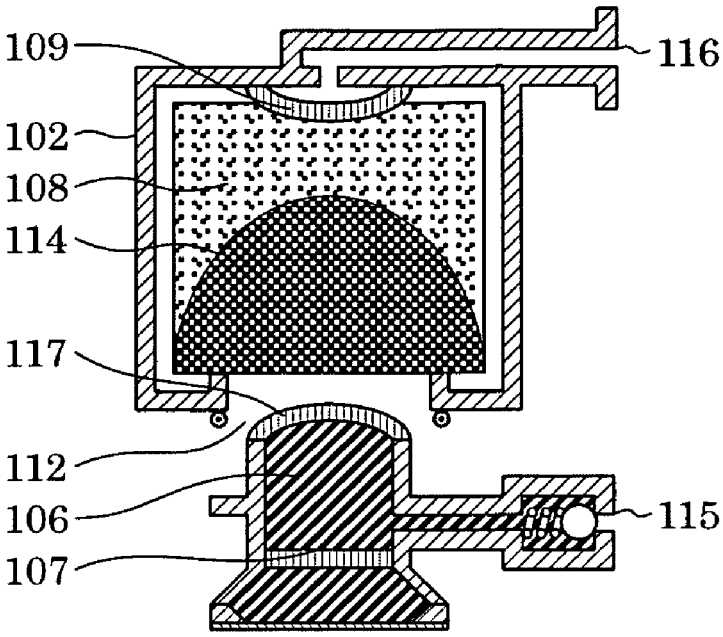
Figure 5:
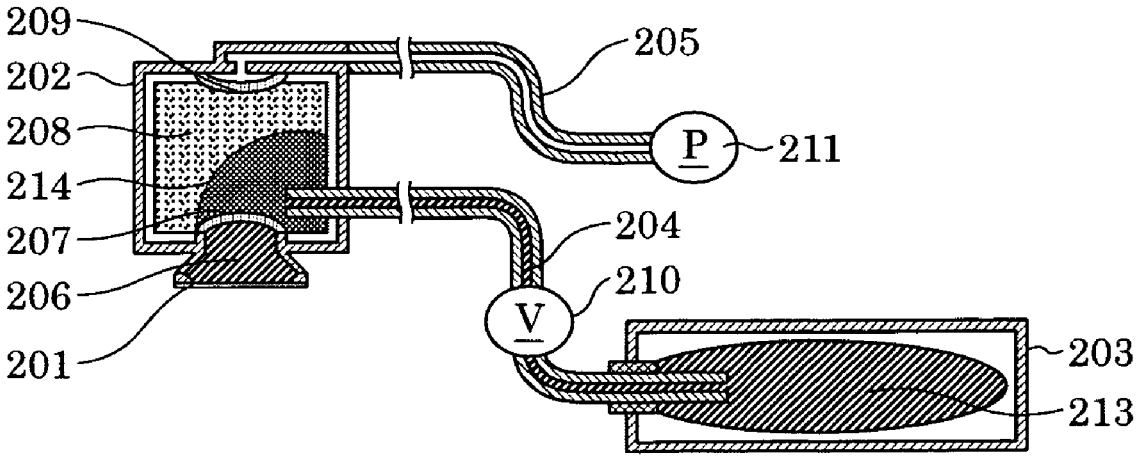
FIG. 5 PRIOR ART
FIG. 5 is a sectional view of an ink supply system of a conventional recording apparatus.

FIGS. 4A and 4B are drawings of an ink supply system of an inkjet printer according to a third embodiment of the present invention.

Features of this embodiment are that the supply tube 104 and the evacuation tube 105 are detachable with the recording head 101 and the sub-tank 102, respectively, and that the sub-tank 102 is detachable with the recording head 101.

As shown in FIG. 4A, the supply tube 104 communicates with the flow path 106 of the recording head 101 at a detachable joint unit 115 of the supply tube 104. Also, the evacuation tube 105 communicates with an upper portion of the sub-tank 102 via a detachable joint unit 116.

The recording head 101 and the sub-tank 102 are mounted on the carriage. When ink is required to be supplied during non-recording, the ink is supplied by connecting two tubes to the sub-tank on the carriage. During recording, the sub-tank is separated from the two tubes, and only the head and the sub-tank are moved for scanning.

Such an ink supply manner is called as an intermittent ink supply system or a pit-in supply system as a matter of convenience.

Also, the sub-tank 102 is detachable with the recording head 101 via a joint unit 117.

According to the structure described above, in addition to the same effects as those of the first embodiment, the carriage can be moved for scanning without a tube connected to the carriage. By this structure, a space in the apparatus for carriage scanning movement can be reduced. Furthermore, the consideration is not required about the load to a carriage drive motor due to a reaction force of the tube against the carriage scanning.

During the carriage movement for scanning, the influence of the vibration of ink within the tube on the ink ejection may also be eliminated.

As the sub-tank is separable from the recording head, when defective conditions in the recording head are encountered, only the recording head is detachable, improving operability in the recording apparatus.

In the so-called pit-in supply system inkjet printer according to the embodiment has known structures in addition to the structures shown in FIGS. 4A and 4B. That is, although not shown in FIGS. 4A and 4B, a carriage having the recording head 101 and the sub-tank 102 mounted thereon is moved in a direction perpendicular to the plane of the drawings so as to scan a recording medium such as recording paper with the recording head 101.

During scanning with the recording head, the sub-tank 102 and the recording head 101 move separating from the evacuation tube 105 and the supply tube 104 at its joint unit, respectively.

When ink is supplied to the sub-tank 102 from the main tank 103, the carriage moves to a predetermined position within the scanning range, and along with this movement, the joint units of the two tubes are connected to the sub-tank on the carriage. Such a pit-in system is described in Japanese Patent Laid-Open No. 2002-160386, for example.

While the present invention has been described with reference to exemplary embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

This application claims priority from Japanese Patent Application No. 2004-124598 filed Apr. 20, 2004, which is hereby incorporated by reference herein.

What is claimed is:

1. An inkjet recording apparatus comprising:

a recording head configured to eject liquid therefrom;

a sub-tank configured to couple to the recording head so as to supply liquid to the recording head, the sub-tank including a negative pressure generating member arranged therein and communicating with the atmosphere;

a carriage movably supporting the recording head and the sub-tank;

a main tank arranged outside the carriage and adapted to store liquid supplied to the sub-tank;

a supply path for supplying the liquid from the main tank;

a depressurizing unit connected to the sub-tank and adapted to depressurize inside the sub-tank;

a gas/liquid separating film arranged at a part to which the depressurizing unit of the sub-tank is connected;

a flow path located between the negative pressure generating member and the recording head so as to facilitate liquid communication from the negative pressure generating member to the recording head, wherein the flow path includes a connection part adapted to connect to the supply path, so as to facilitate direct liquid communication from the supply path to the negative pressure generating member; and a filter provided between one of the flow path and the negative pressure generating part, between the flow path and the recording head, and in the connection part between the flow path and the supply path, wherein the connection part is connected at a downstream side compared to the filter arranged between the flow path and the negative pressure generating part.

2. The apparatus according to claim 1, wherein the recording head is formed integrally with the flow path and detachable from the sub-tank.

3. The apparatus according to claim 1, wherein the recording head is constructed integrally with the flow path, and is detachable from the supply path.

4. The apparatus according to claim 1, wherein the depressurizing unit comprises a depressurizing path, and wherein the sub-tank is detachable from the depressurizing path.

* * * * *